US011043171B2

(12) United States Patent
Chen

(10) Patent No.: US 11,043,171 B2
(45) Date of Patent: Jun. 22, 2021

(54) ANTI-FLICKER AND MOTION-BLUR IMPROVEMENT METHOD AND DISPLAY DEVICE THEREOF

(71) Applicant: QISDA CORPORATION, Taoyuan (TW)

(72) Inventor: Min-Jye Chen, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/917,760

(22) Filed: Jun. 30, 2020

(65) Prior Publication Data

US 2021/0005149 A1 Jan. 7, 2021

(30) Foreign Application Priority Data

Jul. 4, 2019 (CN) ..... 201910601067.3

(51) Int. Cl.
*G09G 3/34* (2006.01)
*G09G 3/36* (2006.01)

(52) U.S. Cl.
CPC ..... *G09G 3/3406* (2013.01); *G09G 3/3648* (2013.01); *G09G 2320/0247* (2013.01)

(58) Field of Classification Search
CPC ..... G09G 3/3406; G09G 3/3648; G09G 2320/0247; G09G 2320/0261
See application file for complete search history.

(56) References Cited

U.S. PATENT DOCUMENTS

2011/0175935 A1* 7/2011 S ..... G09G 3/3406 345/690
2020/0143756 A1* 5/2020 Chen ..... G09G 3/3406

* cited by examiner

*Primary Examiner* — Michael Pervan

(57) ABSTRACT

An anti-flicker and motion-blur improvement method includes selecting one of display modes, obtaining a vertical synchronization signal and a data clock signal, and setting waveforms of a backlight driving signal in a vertical blanking interval and a data scan interval according to the display mode to make a motion blur effect correspond to the display mode. A voltage regulation signal is generated according to the display mode. A duty cycle of the voltage regulation signal is set as a first duty cycle in a dynamic image display mode. The duty cycle of the voltage regulation signal is set as a second duty cycle in a still image display mode. A backlight driving current corresponding to the backlight driving signal is generated via the voltage regulation signal. A current setting port generates a constant current. Accordingly, the present invention can improve the motion blur phenomenon by simplifying the backlight control circuit.

20 Claims, 2 Drawing Sheets

ANTI-FLICKER AND MOTION-BLUR IMPROVEMENT METHOD AND DISPLAY DEVICE THEREOF

BACKGROUND OF THE INVENTION

1. Field of the Invention

The present invention relates to a display method and a display device thereof, and more specifically, to an anti-flicker and motion-blur improvement method and a display device thereof.

2. Description of the Prior Art

Currently, an LCD (Liquid Crystal Display) screen is the most commonly used display device. The LCD screen is a hold-type display apparatus. That is, a pixel intensity of each pixel in an image frame remains at a fixed value until the pixel intensity of the next image frame is updated to a new intensity. Due to the aforesaid characteristics, an object moving in an image remains still in an image frame when the LCD screen displays continuous image frames, so as to result in a motion blur phenomenon. Thus, it may not only reduce image quality of the hold-type LCD screen but also cause a user much discomfort in viewing the continuous image frames. In general, the hold-type LCD screen adopts a black insertion technique (e.g. a backlight black-insertion method) to simulate an impulse-type driving method adopted by a CRT (Cathode Ray Tube) screen for improving the motion blur phenomenon.

As shown in FIG. 1, which is a diagram showing a relationship of Vsync, DLCK, A-DIM, P-DIM and scalar GPIO lightboost in a display device according to the prior art. A circuit design of a synchronous backlight source usually includes a voltage regulation signal A-DIM for adjusting a gain of a backlight current, a voltage pulse signal P-DIM for adjusting a duty cycle of the backlight current, and a current setting port ISET (scalar GPIO Lightboost) for high-current switching of impulse black insertion. After the voltage regulation signal A-DIM and the voltage pulse signal P-DIM are generated, a waveform of the backlight current can be generated logically or according to the voltage regulation signal A-DIM and the voltage pulse signal P-DIM. As such, the backlight current can be generated via a current setting port ISET (GPIO) according to the aforesaid waveform. However, the aforesaid circuit design is very complicated.

SUMMARY OF THE INVENTION

The present invention provides an anti-flicker and motion-blur improvement method. The method includes selecting one of a plurality of display modes and obtaining a vertical synchronization signal and a data clock signal. A data cycle of the data clock signal includes a vertical blanking interval and a data scan interval. The method further provides setting waveforms of a backlight driving signal in the vertical blanking interval and the data scan interval according to the display mode to make a motion blur effect correspond to the display mode. The waveform of the backlight driving signal in the vertical blanking interval is different from the waveform of the backlight driving signal in the data scan interval. A voltage regulation signal is directly generated according to the display mode. A duty cycle of the voltage regulation signal is set as a first duty cycle in a dynamic image display mode. The duty cycle of the voltage regulation signal is set as a second duty cycle in a still image display mode. The backlight driving current corresponding to the backlight driving signal is generated via the voltage regulation signal, and a current setting port generates a constant current.

The present invention further provides an anti-flicker and motion-blur improvement display device including a display panel, a processor, a backlight driving device, a backlight switch, and a backlight unit. The display panel is for displaying an image. The processor is coupled to the display panel for adjusting a display mode of the image. The backlight driving device is coupled to the processor. The backlight driving device is controlled by the processor to generate a backlight driving signal corresponding to the display mode. The backlight switch is coupled to the backlight driving device. The backlight unit is coupled to the backlight switch. The backlight driving device controls the backlight switch according to the backlight driving signal for driving the backlight unit. The processor is used to obtain a vertical synchronization signal and a data clock signal, and a data cycle of the data clock signal includes a vertical blanking interval and a data scan interval. After one of the plurality of display modes is selected, waveforms of the backlight driving signal in the vertical blanking interval and the data scan interval is set according to the display mode to make a motion blur effect correspond to the display mode. The waveform of the backlight driving signal in the vertical blanking interval is different from the waveform of the backlight driving signal in the data scan interval. The processor directly generates a voltage regulation signal according to the display mode. A duty cycle of the voltage regulation signal is set as a first duty cycle in a dynamic image display mode. The duty cycle of the voltage regulation signal is set as a second duty cycle in a still image display mode. The backlight driving current corresponding to the backlight driving signal is generated via the voltage regulation signal, and a current setting port of the backlight driving device generates a constant current.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
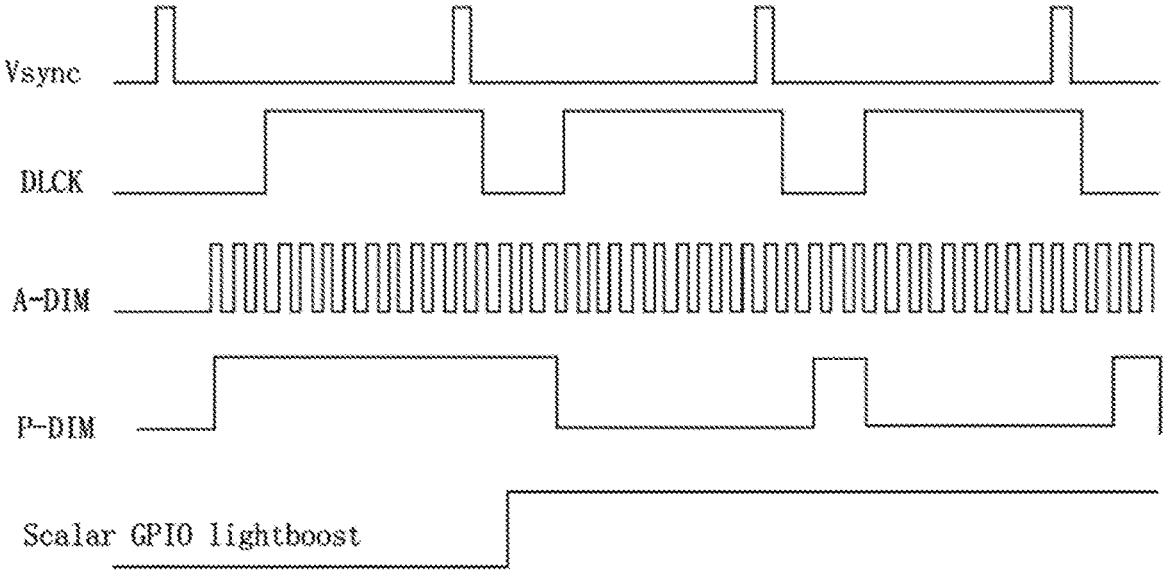
FIG. 1 PRIOR ART
FIG. 1 is a diagram showing a relationship of Vsync, DLCK, A-DIM, P-DIM and scalar GPIO lightboost in a display device according to the prior art.
Figure 2:
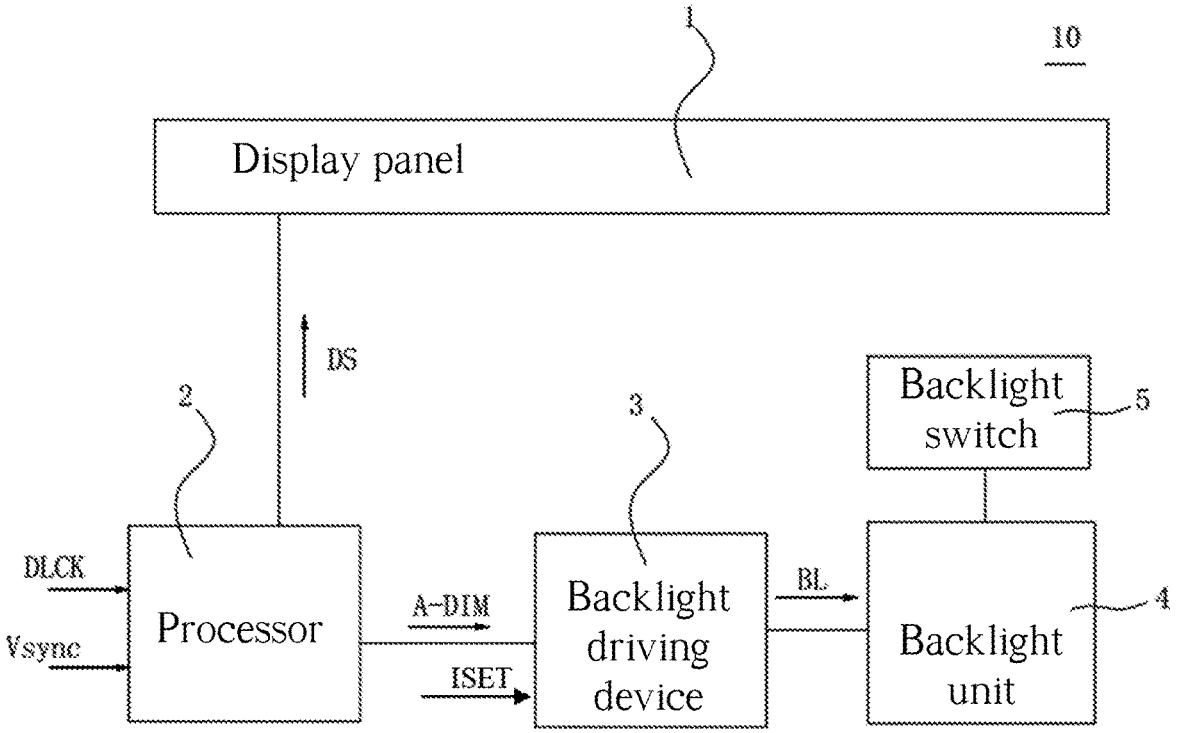
FIG. 2 is a functional block diagram of a display device according to an embodiment of the present invention.

Please refer to FIG. 2, which is a functional block diagram of a display device 10 according to an embodiment of the present invention. The display device 10 includes a display panel 1, a processor 2, a backlight driving device 3, a backlight switch 4, and a backlight unit 5. The display panel 1 is used for displaying images. The display panel 1 could be any kind of display panel, such as an LCD panel or an OLED (Organic Light Emitting Diode) panel. The processor 2 is coupled to the display panel 1 for adjusting images according to different display modes. The processor 2 could be any external or internal processing component, such as a CPU (Central Processing unit), a microprocessor, or a processing chip circuit (e.g. a scalar chip). A scalar chip commonly used in an LCD panel is a signal processing chip for transforming analog image signals of a computer to digital image signals and then outputting the digital image signals to a timing controller of the LCD panel via an interpolation and scaling processing method. The scalar chip is capable of outputting a voltage pulse signal P-DIM and a voltage regulation signal A-DIM. A backlight intensity signal port of the scalar chip is used to output dimming signals of several hundred Hz (larger than 150 Hz) for making a backlight source switched on and off alternately. Since a frequency of a backlight intensity signal is larger than 150 Hz, it is not easy for human eyes to detect alternate switched on and off of the backlight source, so that no flicker occurs when the user views the LCD panel. Thus, a time scale between switched on and off of the backlight source can be adjusted by duty cycle adjustment for brightness control of the LCD panel.

Furthermore, the processor 2 can control the display panel 1 to provide a plurality of display modes for the user to select one of the display modes. The backlight driving device 3 is coupled to the processor 2. The processor 2 can control the backlight driving device 3 to generate a backlight driving signal BL corresponding to the display mode selected by the user. For example, the processor 2 can control the display panel 1 to provide a dynamic image display mode or a still image display mode. When the user selects the dynamic image display mode, the processor 2 can control the backlight driving device 3 to generate a backlight driving signal BL corresponding to the dynamic image display mode. On the other hand, when the user selects the still image display mode, the processor 2 can control the backlight driving device 3 to generate a backlight driving signal BL corresponding to the still image display mode. The backlight switch 4 is coupled to the backlight driving device 3. The backlight switch 4 could be an active circuit composed of a current limiting resistance and a transistor switch. The backlight unit 5 is coupled to the backlight switch 4. The backlight driving device 3 can control the backlight switch 4 by the backlight driving signal BL to drive the backlight unit 5. The backlight unit 5 could be preferably an LCD array, an incandescent light bulb, an electronic-optical panel, or a CCFL (Cold Cathode Fluorescent Lamp), but not limited thereto. After the backlight driving device 3 drives the backlight unit 5 via the backlight switch 4 according to the backlight driving signal BL, the motion blur effect provided by the display panel 1 can correspond to the display mode selected by the user. In this embodiment, a duty cycle or an amplitude of the backlight driving signal BL between a vertical blanking interval and a data scan interval can determine the motion blur effect provided by the display panel 1, and waveforms of the backlight driving signal BL in the vertical blanking interval and the data scan interval are different from each other.

Figure 3:
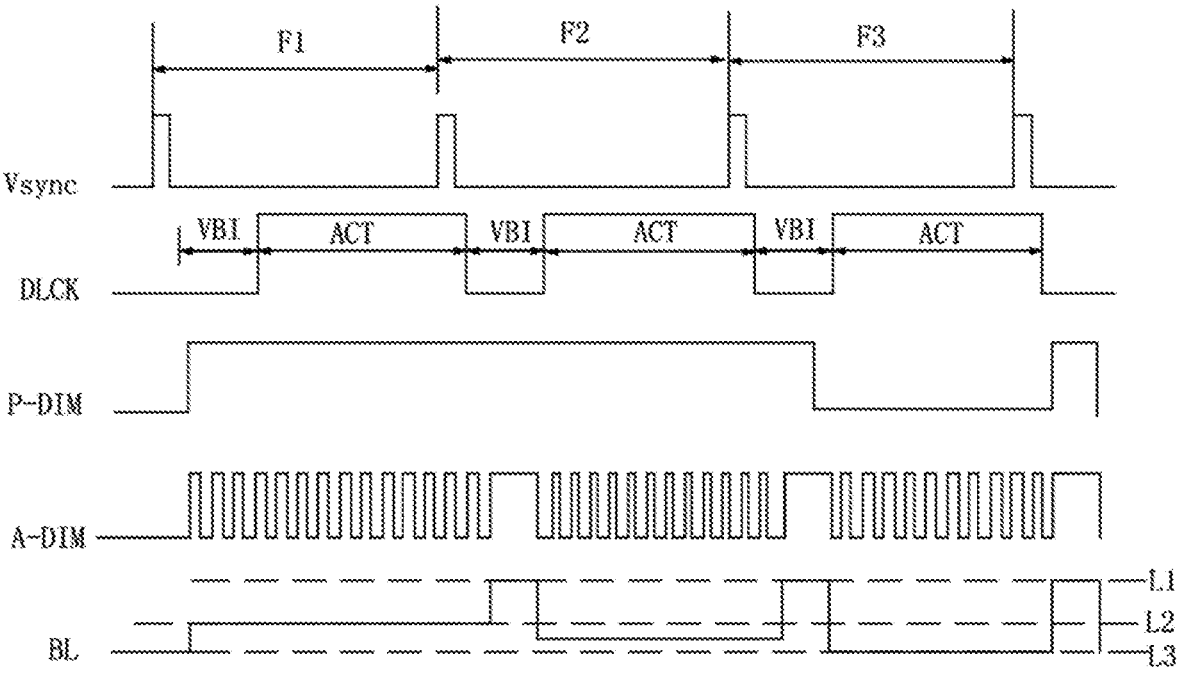
FIG. 3 shows a first relationship of a vertical synchronization signal, a data clock signal, a voltage pulse signal, a voltage regulation signal, and a backlight driving signal in the display device.

FIG. 3 shows a first relationship of a vertical synchronization signal Vsync, a data clock signal DCLK, the voltage pulse signal P-DIM, the voltage regulation signal A-DIM, and the backlight driving signal BL in the display device 10. In the display device 10, after obtaining the vertical synchronization signal Vsync and the data clock signal DCLK having a data cycle including the data scan interval and the vertical blanking interval, the processor 2 can receive information that the user has selected one of the display modes. Subsequently, the processor 2 can generate a panel driving signal DS for driving pixels in the display panel 1. For example, the processor 2 can generate scan line signals and data line signals corresponding to the display panel 1, so as to control the pixels in the display panel 1 via a gate driving circuit and a data driving circuit. A signal cycle of the vertical synchronization signal Vsync is equal to a frame cycle of the display panel 1 in displaying images. For example, a time interval of the vertical synchronization signal Vsync between a high electric potential and a low electric potential can be regarded as a frame cycle. As shown in FIG. 3, the vertical synchronization signal Vsync includes a first frame F1, a second frame F2, and a third frame F3, and the data clock signal DCLK includes a signal having a plurality of square waves. A data cycle of the data clock signal DCLK could be equal to the signal cycle of the vertical synchronization signal Vsync, such as 60 Hz, which means the data cycle is 1/60 second. Furthermore, the data cycle of the data clock signal DCLK includes a data scan interval ACT and a vertical blanking interval VBI. The time interval of the data cycle of the data clock signal DCLK can be delayed a little bit relative to the time interval of the signal cycle of the vertical synchronization signal Vsync. The pixels of the display panel 1 in the data scan interval ACT are in a transient state, and the pixels of the display panel 1 in the vertical blanking interval VBI are in a steady state. The voltage regulation signal A-DIM including a plurality of pulse waves is directly generated by the processor 2 according to the display mode selected by the user, so as to provide an interleaved voltage.

In this embodiment, the processor 2 can generate the voltage pulse signal P-DIM and the voltage regulation signal A-DIM according to the display mode selected by the user to set the waveforms of the backlight driving signal BL in the data scan interval and the vertical blanking interval. In other words, after the backlight driving device 3 receives the voltage pulse signal P-DIM and the voltage regulation signal A-DIM, the backlight driving signal BL can be generated corresponding to the waveforms of the display mode. When the dynamic image display mode is selected, a duty cycle of the voltage regulation signal is set as a first duty cycle, such as 50%. When the still image display mode is selected, the duty cycle of the voltage regulation signal is set as a second duty cycle, such as 100%. Accordingly, a backlight driving current corresponding to the backlight driving signal can be generated via the voltage pulse signal and the voltage regulation signal cooperatively, and a current setting port of the backlight driving device can generate a constant current.

Moreover, a duty cycle of the backlight driving current is controlled via the voltage pulse signal P-DIM, and a gain of the backlight driving current is controlled via the voltage regulation signal A-DIM. The backlight driving current can be formed according to the duty cycle of the backlight driving current and the gain.

For example, when the dynamic image display mode is selected (i.e. the motion blur improvement function is switched off), the voltage regulation signal A-DIM is set as 50% for outputting a regular current in a backlight LED specification of a display panel. On the other hand, when the still image display mode is selected (i.e. the motion blur improvement function is switched on), the voltage regulation signal A-DIM is set as 100% for outputting a high current in the backlight LED specification of the display panel. As shown in FIG. 3, a line L1 represents a peak current, a line L2 represents a maximum backlight current when the ISET function is switched off, and a line L3 represents a minimum backlight current. In such a manner, the present invention can utilize the voltage regulation signal A-DIM to control the gain of the backlight driving current for replacing the ISET function of controlling backlight LED current. That is, the voltage regulation signal A-DIM is used to control the gain of the backlight driving current, and the voltage pulse signal P-DIM is used to control the duty cycle of the backlight driving current. As such, the backlight driving current can be generated according to the voltage pulse signal P-DIM and the voltage regulation signal A-DIM.

In one embodiment, the step of setting the waveforms of the backlight driving signal in the vertical blanking interval and the data scan interval includes setting the first duty cycle of the backlight driving signal in the vertical blanking interval and setting the second duty cycle of the backlight driving signal in the data scan interval to make the motion blur effect correspond to the display mode selected by the user. To be more specific, the processor 2 can control the backlight driving device 3 to set a third duty cycle of the backlight driving signal BL in the data scan interval ACT and set a fourth duty cycle of the backlight driving signal BL in the vertical blanking interval VBI, so as to make the motion blur effect correspond to the display mode selected by the user. As shown in FIG. 3, the waveform of the backlight driving signal BL corresponding to the vertical blanking interval VBI of the second frame F2 has the fourth duty cycle, and the waveform of the backlight driving signal BL corresponding to the data scan interval ACT of the second frame F2 has the third duty cycle. The fourth duty cycle could be larger than, equal to, or less than the third duty cycle. The backlight driving signal BL corresponding to the third duty cycle in the data scan interval ACT has a first energy (could be equal to an integration for the third duty cycle in the data scan interval ACT), and the backlight driving signal BL corresponding to the fourth duty cycle in the vertical blanking interval VBI has a second energy (could be equal to an integration for the fourth duty cycle in the vertical blanking interval VBI). When the dynamic image display mode is selected, a ratio of the second energy to the first energy is bigger. When the still image display mode is selected, a ratio of the second energy to the first energy is smaller. For example, in the second frame F2, if the third duty cycle of the waveform of the backlight driving signal BL corresponding to the data scan interval ACT of the second frame F2 is very large, the ratio of the second energy to the first energy of the second frame F2 is larger than the ratio of the second energy to the first energy of the first frame F1. On the contrary, if the third duty cycle of the waveform of the backlight driving signal BL corresponding to the data scan interval ACT of the second frame F2 is very small, the ratio of the second energy to the first energy of the second frame F2 is less than the ratio of the second energy to the first energy of the first frame F1. Thus, if the duty cycle of the backlight driving signal BL of the display device 10 in each frame is set corresponding to the display mode selected by the user, the display device 10 can provide optimized images for greatly improving the motion blur phenomenon. If the duty cycle of the backlight driving signal is set as 100%, the backlight unit of the display device can be switched to an anti-flicker mode.

In another embodiment, the step of setting the waveforms of the backlight driving signal in the vertical blanking interval and the data scan interval includes setting the first amplitude (i.e. current) of the backlight driving signal in the vertical blanking interval and the second amplitude (i.e. current) of the backlight driving signal in the data scan interval to make the motion blur effect correspond to the display mode selected by the user.

Figure 4:
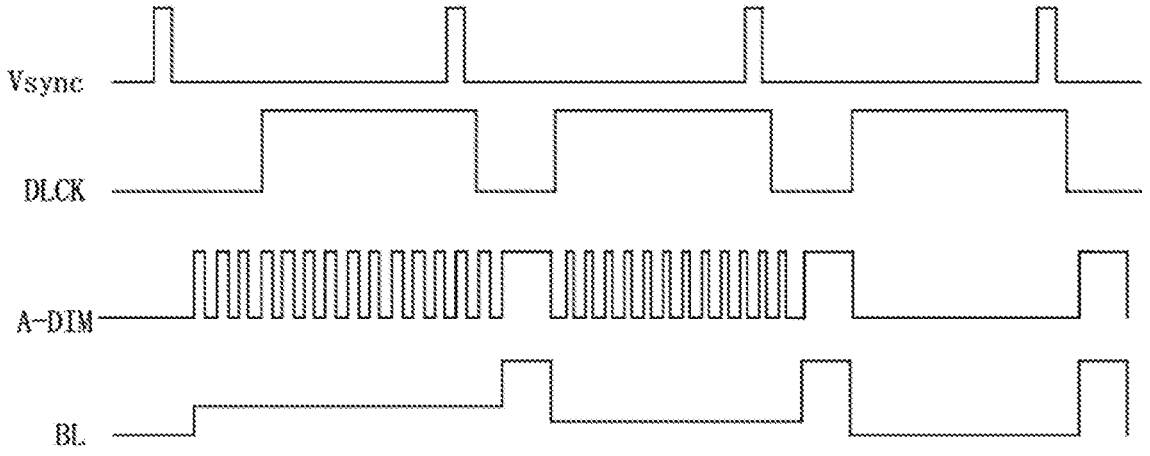
FIG. 4 shows a second relationship of the vertical synchronization signal, the data clock signal, the voltage regulation signal, and the backlight driving signal in the display device in FIG. 2.

FIG. 4 shows a second relationship of the vertical synchronization signal Vsync, the data clock signal DCLK, the voltage regulation signal A-DIM, and the backlight driving signal BL in the display device 10 in FIG. 2. In this embodiment, when the dynamic image display mode is selected, the duty cycle of the voltage regulation signal is set as the first duty cycle, such as 50%. When the still image display mode is selected, the duty cycle of the voltage regulation signal is set as the second duty cycle, such as 100%. Accordingly, the backlight driving current corresponding to the backlight driving signal can be generated according to the voltage regulation signal, and the current setting port of the backlight driving device can generate a constant current.

That is, when the dynamic image display mode is selected (i.e. the motion blur improvement function is switched off), the voltage regulation signal A-DIM is set as 50% for outputting the regular current in the backlight LED specification of the display panel. On the other hand, when the still image display mode is selected (i.e. the motion blur improvement function is switched on), the voltage regulation signal A-DIM is set as 100% for outputting the high current in the backlight LED specification of the display panel. In such a manner, the present invention can utilize the voltage regulation signal A-DIM to control the backlight driving current for replacing the ISET function of controlling the backlight LED current. That is, the voltage regulation signal A-DIM is used to control the gain and duty cycle of the backlight driving current. As such, the present invention can utilize the voltage regulation signal A-DIM to replace the ISET and P-DIM functions of controlling the backlight LED current, so as to greatly simplify the control circuit of the backlight driving device 3.

Furthermore, the present invention provides a flicker-free display and motion-blur improvement method to be applied to the display device 10. The method includes selecting one of the plurality of display modes and obtaining the vertical synchronization signal and the data clock signal. The data cycle of the data clock signal includes the vertical blanking interval and the data scan interval. The method further includes setting the waveforms of the backlight driving signal in the vertical blanking interval and the data scan interval according to the display mode to make the motion blur effect correspond to the display mode. The waveform of the backlight driving signal in the vertical blanking interval is different from the waveform of the backlight driving signal in the data scan interval. The voltage regulation signal is directly generated according to the display mode. The duty cycle of the voltage regulation signal is set as a first duty cycle in the dynamic image display mode. The duty cycle of the voltage regulation signal is set as a second duty cycle in a still image display mode. The backlight driving current corresponding to the backlight driving signal is generated via the voltage regulation signal, and a current setting port generates a constant current.

Moreover, the method further includes directly generating the voltage pulse signal according to the display mode. The backlight driving current is generated according to the voltage regulation signal and the voltage pulse signal. The voltage pulse signal controls the duty cycle of the backlight driving current. The voltage regulation signal controls the gain of the backlight driving current. The backlight driving current can be formed according to the duty cycle of the backlight driving current and the gain.

In summary, the anti-free and motion-blur improvement method of the present invention and the display device thereof adopt the backlight black insertion design and the display design of simplifying the backlight control circuit to simulate the impulse-type driving method of the CRT display, so as to improve the motion blur phenomenon. In the present invention, the scalar chip is utilized to directly generate the waveform of the voltage regulation signal A-DIM, the current setting port ISET is utilized to generate a constant current, and the backlight driving current is generated according to the voltage pulse signal P-DIM and the voltage regulation signal A-DIM. Even in one embodiment of omitting the voltage pulse signal P-DIM, the backlight driving current in the data scan interval and the vertical blanking interval can be controlled only by the voltage regulation signal A-DIM, which means that the function of adjusting the backlight driving current is no more performed by the current setting port ISET. The present invention can be applied to a personal computer, a notebook, a tablet device, a television, a projector and other related electronic products.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An anti-flicker and motion-blur improvement method comprising:

selecting one of a plurality of display modes;

obtaining a vertical synchronization signal and a data clock signal, a data cycle of the data clock signal comprising a vertical blanking interval and a data scan interval; and setting waveforms of a backlight driving signal in the vertical blanking interval and the data scan interval according to the display mode to make a motion blur effect correspond to the display mode, the waveform of the backlight driving signal in the vertical blanking interval being different from the waveform of the backlight driving signal in the data scan interval;

wherein a voltage regulation signal is directly generated according to the display mode;

a duty cycle of the voltage regulation signal is set as a first duty cycle in a dynamic image display mode;

the duty cycle of the voltage regulation signal is set as a second duty cycle in a still image display mode;

a backlight driving current corresponding to the backlight driving signal is generated via the voltage regulation signal, and a current setting port generates a constant current.

2. The anti-flicker and motion-blur improvement method of claim 1 further comprising:

directly generating a voltage pulse signal according to the display mode, the backlight driving signal being generated via the voltage regulation signal and the voltage pulse signal cooperatively.

3. The anti-flicker and motion-blur improvement method of claim 2, wherein the voltage pulse signal controls a duty cycle of the backlight driving current, the voltage regulation signal controls a gain of the backlight driving current, and the backlight current is formed according to the duty cycle of the backlight current and the gain.

4. The anti-flicker and motion-blur improvement method of claim 1, wherein the first duty cycle is 50% and the second duty cycle is 100%.

5. The anti-flicker and motion-blur improvement method of claim 1, wherein the step of setting the waveforms of the backlight driving signal in the vertical blanking interval and the data scan interval according to the display mode to make the motion blur effect correspond to the display mode comprises setting a third duty cycle of the backlight driving signal in the vertical blanking interval and a fourth duty cycle of the backlight driving signal in the data scan interval to make the motion effect correspond to the display mode, or comprises setting a first amplitude of the backlight driving signal in the vertical blanking interval and a second amplitude of the backlight driving signal in the data scan interval to make the motion blur effect correspond to the display mode.

6. The anti-flicker and motion-blur improvement method of claim 1, wherein a data cycle of the data clock signal is equal to a signal cycle of the vertical synchronization signal.

7. The anti-flicker and motion-blur improvement method of claim 1, wherein a time interval of a data cycle of the data clock signal is delayed relative to a time interval of a signal cycle of the vertical synchronization signal.

8. The anti-flicker and motion-blur improvement method of claim 1, wherein when the dynamic image display mode is selected, the voltage regulation signal is set as 50% for outputting a regular current in a backlight LED specification of a display panel.

9. The anti-flicker and motion-blur improvement method of claim 1, wherein when the still image display mode is selected, the voltage regulation signal is set as 100% for outputting a high current in a backlight LED specification of a display panel.

10. An anti-flicker and motion-blur improvement display device comprising:

a display panel for displaying an image;

a processor coupled to the display panel for adjusting a display mode of the image;

a backlight driving device coupled to the processor, the backlight driving device being controlled by the processor to generate a backlight driving signal corresponding to the display mode;

a backlight switch coupled to the backlight driving device; and a backlight unit coupled to the backlight switch;

wherein the backlight driving device controls the backlight switch according to the backlight driving signal for driving the backlight unit;

the processor is used to obtain a vertical synchronization signal and a data clock signal, and a data cycle of the data clock signal comprises a vertical blanking interval and a data scan interval;

after one of the plurality of display modes is selected, waveforms of the backlight driving signal in the vertical blanking interval and the data scan interval is set according to the display mode to make a motion blur effect correspond to the display mode, and the waveform of the backlight driving signal in the vertical blanking interval is different from the waveform of the backlight driving signal in the data scan interval;

the processor directly generates a voltage regulation signal according to the display mode;

a duty cycle of the voltage regulation signal is set as a first duty cycle in a dynamic image display mode;

the duty cycle of the voltage regulation signal is set as a second duty cycle in a still image display mode;

a backlight driving current corresponding to the backlight driving signal is generated via the voltage regulation signal, and a current setting port of the backlight driving device generates a constant current.

11. The anti-flicker and motion-blur improvement display device of claim 10, wherein the processor directly generates a voltage pulse signal according to the display mode, and the backlight driving signal is generated via the voltage regulation signal and the voltage pulse signal cooperatively.

12. The anti-flicker and motion-blur improvement display device of claim 11, wherein the voltage pulse signal controls a duty cycle of the backlight driving current, the voltage regulation signal controls a gain of the backlight driving current, and the backlight current is formed according to the duty cycle of the backlight current and the gain.

13. The anti-flicker and motion-blur improvement display device of claim 10, wherein the first duty cycle is 50% and the second duty cycle is 100%.

14. The anti-flicker and motion-blur improvement display device of claim 10, wherein a third duty cycle of the backlight driving signal in the vertical blanking interval and a fourth duty cycle of the backlight driving signal in the data scan interval is set to make the motion effect correspond to the display mode, or a first amplitude of the backlight driving signal in the vertical blanking interval and a second amplitude of the backlight driving signal in the data scan interval is set to make the motion blur effect correspond to the display mode.

15. The anti-flicker and motion-blur improvement display device of claim 10, wherein a data cycle of the data clock signal is equal to a signal cycle of the vertical synchronization signal.

16. The anti-flicker and motion-blur improvement display device of claim 10, wherein a time interval of a data cycle of the data clock signal is delayed relative to a time interval of a signal cycle of the vertical synchronization signal.

17. The anti-flicker and motion-blur improvement display device of claim 10, wherein when the dynamic image display mode is selected, the voltage regulation signal is set as 50% for outputting a regular current in a backlight LED specification of a display panel.

18. The anti-flicker and motion-blur improvement display device of claim 10, wherein when the still image display mode is selected, the voltage regulation signal is set as 100% for outputting a high current in a backlight LED specification of a display panel.

19. The anti-flicker and motion-blur improvement display device of claim 10, wherein the backlight switch is an active circuit composed of a current limiting resistance and a transistor switch.

20. The anti-flicker and motion-blur improvement display device of claim 10, wherein the backlight unit is an LCD array, an incandescent light bulb, an electronic-optical panel, or a CCFL (Cold Cathode Fluorescent Lamp).

* * * * *